US010677237B2

(12) United States Patent
Li

(10) Patent No.: US 10,677,237 B2
(45) Date of Patent: Jun. 9, 2020

(54) DRIP TIGHT PUMP

(71) Applicant: Foshan Yakeqi Electronic Appliance Co., Ltd., Foshan, Guangdong (CN)

(72) Inventor: Qihong Li, Guangdong (CN)

(73) Assignee: Foshan Yakeqi Electronic Appliance Co., Ltd., Foshan (CN)

( * ) Notice: Subject to any disclaimer, the term of this patent is extended or adjusted under 35 U.S.C. 154(b) by 453 days.

(21) Appl. No.: 15/346,758

(22) Filed: Nov. 9, 2016

(65) Prior Publication Data

US 2017/0130731 A1 May 11, 2017

(30) Foreign Application Priority Data

Nov. 9, 2015 (CN) ..... 2015 1 0754425

(51) Int. Cl.

| | |
|---|---|
| ***F04D 29/08*** | (2006.01) |
| ***F04B 43/00*** | (2006.01) |
| ***F04B 43/08*** | (2006.01) |
| ***F04B 9/04*** | (2006.01) |
| ***F04B 53/10*** | (2006.01) |
| ***F04B 39/10*** | (2006.01) |

(52) U.S. Cl.

CPC ..... *F04B 43/0045* (2013.01); *F04B 9/045* (2013.01); *F04B 39/108* (2013.01); *F04B 43/086* (2013.01); *F04B 53/10* (2013.01); *F04B 53/1037* (2013.01); *F04D 29/08* (2013.01)

(58) Field of Classification Search

CPC ..... F04B 27/0839; F04B 39/1066; F04B 39/1073; F04B 39/108; F04B 43/0045; F04B 43/02; F04B 43/025; F04B 45/04; F04B 53/1037; F04B 53/1047; F04B 43/026; F04B 45/043; F04B 1/122; F04B 27/1009; F04B 39/08; F04B 43/0054; F04B 45/022

See application file for complete search history.

(56) References Cited

U.S. PATENT DOCUMENTS

| | | | | | |
|---|---|---|---|---|---|
| 5,707,219 | A * | 1/1998 | Powers | F04B 43/067 | 417/269 |
| 5,800,136 | A * | 9/1998 | Kurth | F04B 49/24 | 417/269 |
| 6,071,089 | A * | 6/2000 | Maier | F02M 59/14 | 417/386 |
| 9,217,425 | B2 * | 12/2015 | Looi | F04B 9/045 | |
| 9,739,271 | B2 * | 8/2017 | Chang | F04B 1/122 | |
| 10,087,922 | B2 * | 10/2018 | Cai | F04B 9/042 | |
| 2009/0068036 | A1 * | 3/2009 | Hsu | F04B 43/026 | 417/410.1 |
| 2011/0189041 | A1 * | 8/2011 | Zhang | F04B 39/10 | 417/560 |

(Continued)

*Primary Examiner* — Dominick L Plakkoottam

(57) ABSTRACT

A drip tight pump includes a top cover with an inlet port and an outlet port, a sealing mat, a valve plate with an inlet hole and an outlet hole, a water inlet one-way valve, a cup, a cylinder, a swing frame, a steel needle, a steel ball, an eccentric wheel, a bottom cover and a motor which are successively set. The drip tight pump also includes a first leak-proof member and/or a second leak-proof member between the top cover and the sealing mat. The drip tight pump can seal the outlet hole and the inlet port, so that to prevent the drip tight pump from dripping.

9 Claims, 7 Drawing Sheets

(56) References Cited

U.S. PATENT DOCUMENTS

| | | | | |
|---|---|---|---|---|
| 2012/0097274 | A1* | 4/2012 | Cai | F04B 43/026 137/565.11 |
| 2013/0034452 | A1* | 2/2013 | Itahara | F04B 43/02 417/321 |
| 2014/0154117 | A1* | 6/2014 | Fukami | F04B 43/026 417/413.1 |
| 2016/0040664 | A1* | 2/2016 | Zhang | F04B 39/1073 417/473 |

* cited by examiner

DRIP TIGHT PUMP

CROSS-REFERENCE TO RELATED PATENT APPLICATION

The present patent application claims priority to Chinese patent application No. 201510754425.6 filed on Nov. 9, 2015, the entire contents of which are incorporated by reference.

BACKGROUND

Technical Field

The present disclosure relates to liquid extraction device technical field, and more particularly, to a kind of drip tight pump.

Description of Relate Art

A pump is a machine to lift liquid, to transport liquid or to increase pressure of liquid. The pump puts mechanical energy of a prime mover or other external energy into the liquid. Then the pump increases pressure of the liquid in order to lift and transport the liquid. The pump is mainly used to transport liquids including water, oil, acid and alkali liquid, emulsion, suspension emulsion and liquid metal etc. The pump is also used to transport mixture of liquid and gas, and to transport liquid including suspension solid matter.

A pump usually includes a driving portion and a pump casing. The pump casing includes an inlet port and an outlet port. Pumps those who adopt water enter the pump casing from the inlet port and exit the pump casing from the outlet port, and who have small volumes are called micro pump or micro water pump.

After lifting and transporting liquid of micro pumps of current technology, a small portion of liquid will be remained in cups of the micro pumps. The remained liquid will fall along the outlet port because of inertia. Also the liquid will enter the cups of the micro along the inlet port because of inertia. Thus, dripping phenomenon appears of the micro pumps. Micro pumps with dripping phenomenon do not conductive of practical application.

What is needed, therefore, is a kind of drip tight pump thereof which has simple structure and good sealing, can be used to seal the outlet port and the inlet port, and also can avoid dripping phenomenon of the tight pump.

SUMMARY OF THE INVENTION

The present invention is to solve the technical problem which is to provide a kind of drip tight pump with characteristics of simple structure and good sealing. The drip tight pump can seal the outlet hole and the inlet port, so that to prevent the drip tight pump from dripping.

The present invention provides a drip tight pump to solve the technical problem described above. The drip tight pump includes a top cover with an inlet port and an outlet port, a sealing mat, a valve plate with an inlet hole and an outlet hole, a water inlet one-way valve, a cup, a cylinder, a swing frame, a steel needle, a steel ball, an eccentric wheel, a bottom cover and a motor which are successively set. The drip tight pump also includes a first leak-proof member and/or a second leak-proof member between the top cover and the sealing mat. The first leak-proof member includes a first elastic portion and a first leak-proof portion, the outlet port, the first elastic portion, the first leak-proof portion and the outlet hole are setting in a same straight line, one end of the first elastic portion is connecting a bottom end of the outlet port, another end of the first elastic portion is connecting a top end of the leak-proof portion, the first leak-proof portion is used for sealing the outlet hole. The second leak-proof member includes a second elastic portion and a second leak-proof portion, the inlet port, the second elastic portion, and the second leak-proof portion are setting in a same straight line, one end of the second leak-proof portion is connecting a bottom end of the inlet port, another end of the second leak-proof portion is connecting a top end of the second elastic portion, the second leak-proof portion is used for sealing the inlet port.

As an improvement of the above drip tight pump, the first leak-proof portion and the second leak-proof portion are umbrella-shaped valves.

As an improvement of the above drip tight pump, the umbrella-shaped valves include a sealing flap and a connecting end which is integrally formed with the sealing flap.

As an improvement of the above drip tight pump, the connecting end of the first leak-proof portion is set at a bottom end of the sealing flap of the first leak-proof portion, the connecting end of the first leak-proof portion shapes like an inverted conical.

As an improvement of the above drip tight pump, the connecting end of the second leak-proof portion is set at a top end of the sealing flap of the second leak-proof portion, the connecting end of the second leak-proof portion shapes like an inverted conical.

As an improvement of the above drip tight pump, the first elastic portion and the second elastic portion are springs.

As an improvement of the above drip tight pump, the water inlet one-way value valve is an umbrella-shaped valve using for sealing the inlet hole.

As an improvement of the above drip tight pump, the top cover, the top cover, the valve plate and the cylinder are fastened on the bottom cover by screws.

As an improvement of the above drip tight pump, the bottom cover and the motor are connected by screws.

Implementation of the present can achieve the following benefits effects.

The drip tight pump of the present invention includes a first leak-proof member and/or a second leak-proof member between the top cover and the sealing mat, wherein the first leak-proof member is used for sealing the outlet hole, the second leak-proof member is used for sealing the inlet port.

The first leak-proof member includes the first elastic portion and the first leak-proof portion. The inlet port, the first elastic portion, the first leak-proof portion and the outlet port are setting in a same straight line, making the first leak-proof portion sealing the outlet hole effectively. When the first leak-proof portion is suffering thrusts greater than elastic force of the first elastic portion, the first elastic portion will shrink and leave the outlet hole. Liquid in the cup will flow into the top cover along the outlet hole, then flow out of the drip tight pump along the outlet port. When the first leak-proof portion is suffering thrusts less than elastic force of the first elastic portion, the first elastic portion will stretch, the first leak-proof portion blocks the outlet hole under the force of the first elastic portion, making the first leak-proof portion sealing the outlet hole, preventing liquid in the cup from flowing out, and also preventing liquid out of the outlet port from flowing back the drip tight pump.

The second leak-proof member includes the second elastic portion and the second leak-proof portion. The inlet port, the second elastic portion, and the second leak-proof portion are setting in a same straight line, making the second leak-proof portion sealing the outlet hole effectively. When the second leak-proof portion is suffering thrusts greater than elastic force of the second elastic portion, the second elastic portion will shrink and leave the inlet port. Liquid in the cup will flow into the top cover along the inlet port. When the second leak-proof portion is suffering thrusts less than elastic force of the second elastic portion, the second elastic portion will stretch and push the second leak-proof portion moving to the inlet port, making the second leak-proof portion sealing the inlet port, preventing liquid from flowing in or flowing out.

At the same time, the first elastic portion and the second elastic portion are independent from each other. The first elastic portion and the second elastic portion can be changed from different elastic portion of different elastic coefficient according to actual use requirements. By controlling the elastic coefficient of the first elastic portion and the second elastic portion, drip tight effect of the drip tight pump can be guarantee. The drip tight pump has strong flexibility and applicability.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
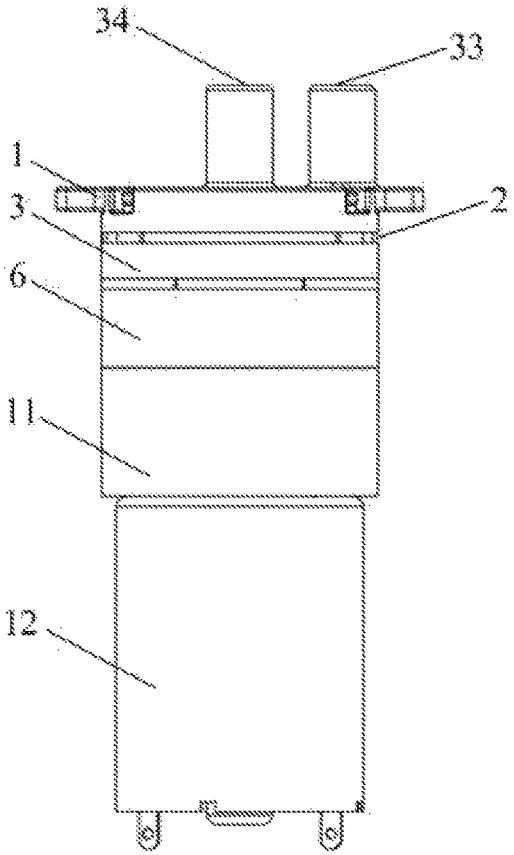
FIG. 1 is a main view of structure diagram in accordance with a first embodiment of the present drip tight pump.
Figure 2:
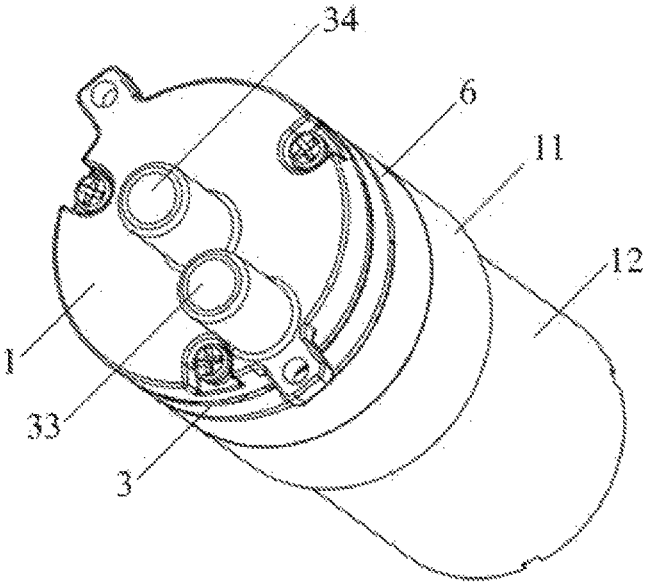
FIG. 2 is a stereo combination diagram in accordance with the first embodiment of the present drip tight pump.
Figure 3:
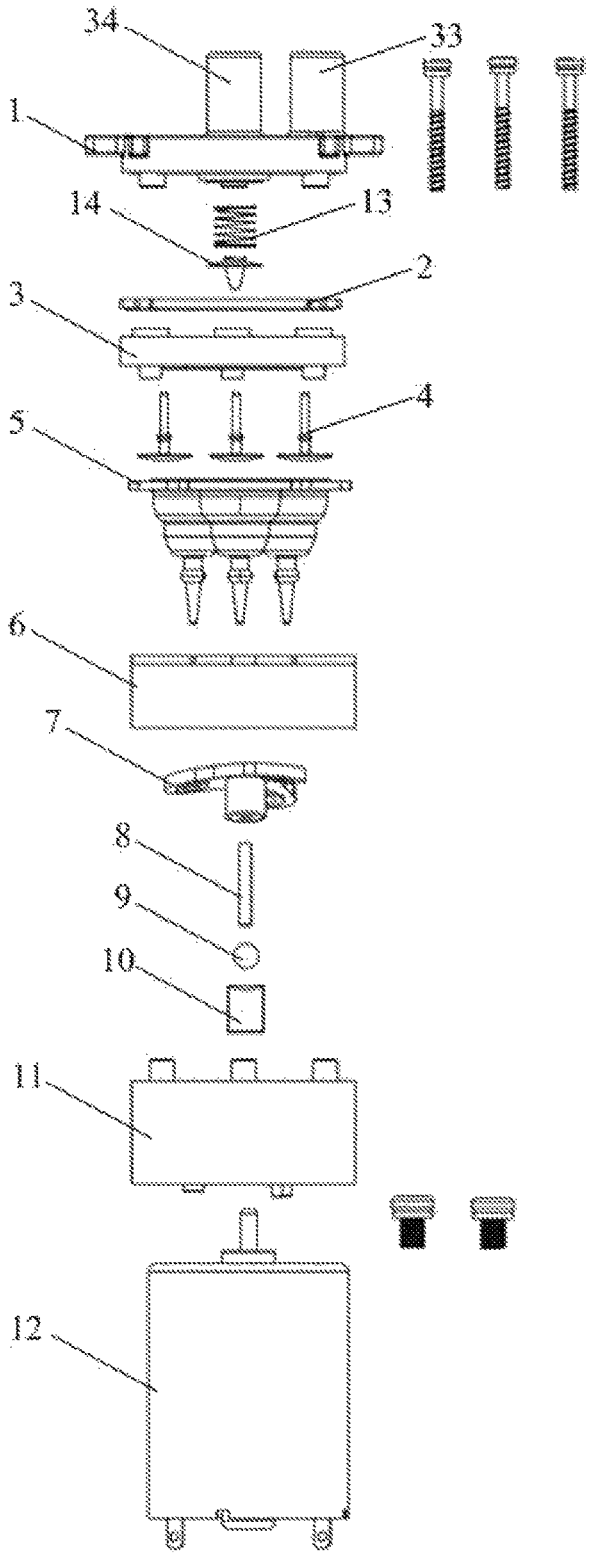
FIG. 3 is an exploded diagram in accordance with the first embodiment of the present drip tight pump.
Figure 4:
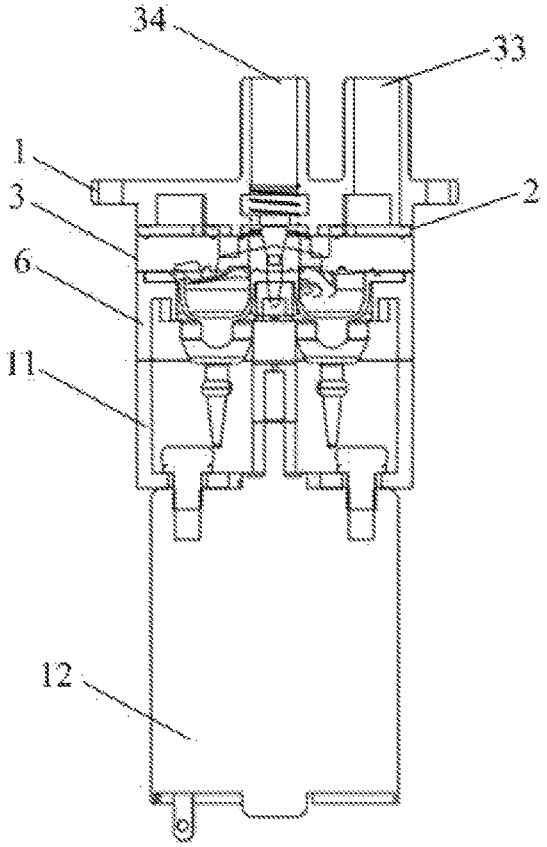
FIG. 4 is a main cross section diagram in accordance with the first embodiment of the present drip tight pump.
Figure 5:
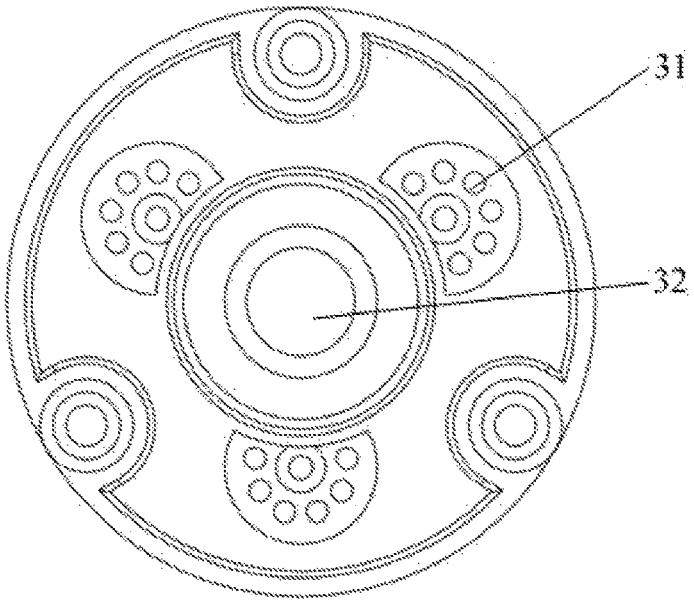
FIG. 5 is a structure diagram of a valve plate in accordance with the first embodiment of the present drip tight pump.

Referring to FIGS. 1-6, a drip tight pump of a first embodiment is shown. The drip tight pump includes a top cover 1, a sealing mat 2, a valve plate 3, a water inlet one-way valve 4, a cup 5, a cylinder 6, a swing frame 7, a steel needle 8, a steel ball 9, an eccentric wheel 10, a bottom cover 11 and a motor 12. An output shaft of the motor 12 is set on the bottom cover 11. The eccentric wheel 10 is sleeved on the output shaft of the motor 12. The steel ball 9 and the steel needle 8 are inserted in an eccentric hole of the eccentric wheel 10 and the steel needle 8 is set inside the swing frame 7. The swing frame 7 includes at least one swing arm, and holes of each swing arm are coordinated with a handle of the bottom of the cup 5. The cup 5 is set through holes of the cylinder 6. The cylinder 6 is set on the bottom of the valve plate 3. The valve plate 3 includes an inlet hole 31 and at least one outlet hole 32 (referring to FIG. 5). The water inlet one-way valve 4 is set in the inlet hole 31. Top of the valve plate 3 is connected to the top cover 1 through the sealing mat 2. The top cover 1 includes an inlet port 33 and an outlet port 34. The top cover 1, the valve plate 3 and the cylinder 6 are fastened on the bottom cover 11 by screws. The bottom cover 11 and the motor 12 are connected by screws. The drip tight pump also only includes a first leak-proof member between the top cover 1 and the sealing mat 2. The first leak-proof member is used for sealing the outlet hole 32. Preferably but not limited, the water inlet one-way 4 is an umbrella-shaped valve. The water inlet one-way valve 4 can be chosen from other shapes valve who can seal the inlet hole 31.

Specifically, the first leak-proof member includes a first elastic portion 13 and a first leak-proof portion 14. The inlet port 34, the first elastic portion 13, the first leak-proof portion 14 and the outlet hole 32 are set in a same straight line. One end of the first elastic portion 13 connects a bottom end of the outlet port 34. The other end of the elastic portion 13 connects a top end of the first leak-proof portion 14. The first leak-proof portion 14 can slide up and down along inner wall of the outlet hole 32. The first leak-proof portion 14 is used for sealing the outlet hole 32.

When using the drip tight pump of the first embodiment, the motor 12 is power on. The output shaft of the motor 12 drives the steel needle 8 rotating by the eccentric wheel 10. Then the rotating steel needle 8 drives the swing frame 7 rotating around the output shaft of the motor 12 and makes arm movement of the swing frame 7 pulling the cup 5 doing stretching and compression motion, so as to changing inside cavity volume of the cup 5. When inside cavity volume of the cup 5 is larger, cavity of the cup 5 is inhaling. Liquid outside the drip tight pump will flow into the top cover 1 along the inlet port 33 and further flow into the cavity of the cup 5 along the inlet hole 31 through the water inlet one-way valve 4. At this time, the first leak-proof portion 14 will block the outlet hole 32 because of action of the first elastic portion 13. When inside cavity volume of the cup 5 is smaller, atmospheric pressure of the cup 5 has positive high voltage valve, liquid inside the drip tight pump will apply thrust to the first leak-proof portion 14. When the thrust force is larger than elastic force of the first elastic portion 13, the first elastic portion 13 will shrink upwards and leave the outlet hole 32. Liquid flows into the top cover 1 along the outlet hole 32 and further flow out of drip tight pump along the outlet port 34 through the top cover 1. At this time, the water inlet one-way valve 4 is closed. The motor 12 is power off and stops motion to make the drip tight pump stopping pumping. The cavity of the cup 5 stops inhaling, then liquid inside the cavity of the cup 5 still flow to the outlet hole 32 because inertia. But the thrust force of the liquid applying to the first leak-proof portion 14 is obviously decrease, and makes the thrust force smaller than elastic force, then the first elastic portion 13 is stretching downwards, the first leak-proof portion 14 will block the outlet hole 32 because of action of the first elastic portion 13 achieving the first leak-proof portion 14 sealing the outlet hole 32. It can prevent liquid inside the cup 5 from flowing out, and prevent dripping phenomenon of the drip tight pump. At the same time, liquid out of the outlet port 34 will flow back to the drip tight pump. At this time, liquid who is flowing back can't through the outlet hole 32 because of stop of the first leak-proof portion 14. It can effectively prevent dripping.

Comparing with the prior art, the first elastic portion 13 and the first leak-proof portion 14 are setting between the outlet port 34 and the outlet hole 32. It makes the first leak-proof portion 14 effectively sealing the outlet hole 32. When the thrust force apply to the first leak-proof portion 14 is larger than elastic force of the first elastic portion 13, the first elastic portion 13 will shrink and leave the outlet hole 32, liquid inside the cavity of the cup 5 will flow to the top cover 1 along the outlet hole 32 then flow out the drip tight pump along the outlet port 34 through the top cover 1. When the thrust force apply to the first leak-proof portion 14 is obviously smaller than elastic force of the first elastic portion 13, the first elastic portion 13 will stretch, then the first leak-proof portion 14 will block the outlet hole 32 because of action of the first elastic portion 13 and make the first leak-proof portion 14 sealing the outlet hole 32. It prevents liquid flowing outside from the cavity of the cup 5 and effectively prevents dripping phenomenon of the drip tight pump.

Figure 6:
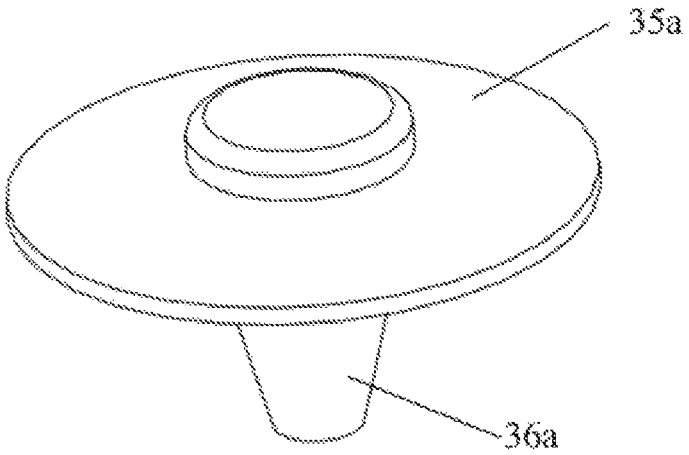
FIG. 6 is a structure diagram of a first leak-proof portion in accordance with the first embodiment of the present drip tight pump.

Referring to FIG. 6, the first leak-proof portion 14 is umbrella-shaped valves. The first leak-proof portion 14 includes a sealing flap 35*a* and a connecting end 36*a* which is connected to bottom of the sealing flap 35*a* of the first leak-proof portion 14. The sealing flap 35*a* is used to seal the outlet hole 32. The sealing flap 35*a* can guarantee tightness of the outlet hole 32 effectively. The sealing flap 35*a* makes liquid can't flow out of the outlet hole 32 after the motor 12 is power off so as to achieve drip tight effect. Preferably, the connecting end 36*a* of the first leak-proof portion 14 shapes like an inverted conical which can lead the first leak-proof portion 14 set into the outlet hole 32 and guarantee the first leak-proof portion 14 can slide up and down along inner wall of the outlet hole 32 without departing from limit of the outlet hole 32 and sealing the outlet hole 32 effectively when the drip tight pump is working.

Figure 7:
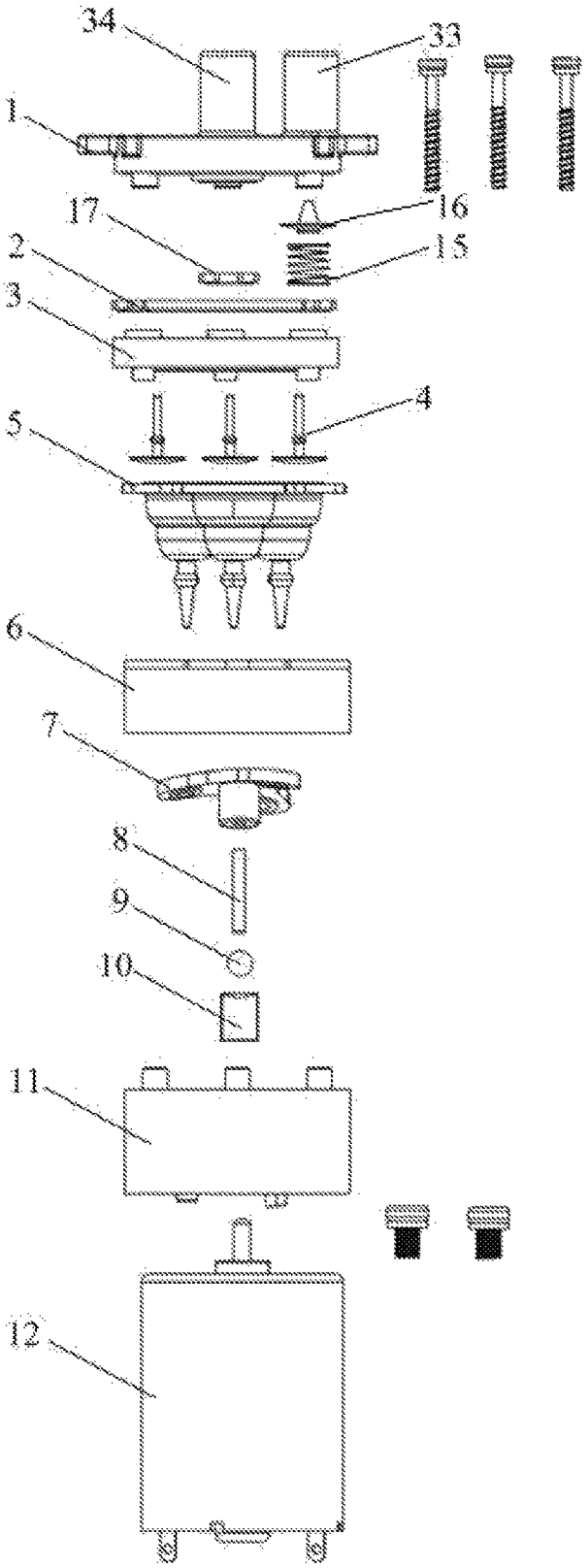
FIG. 7 is an exploded diagram in accordance with a second embodiment of the present drip tight pump.
Figure 8:
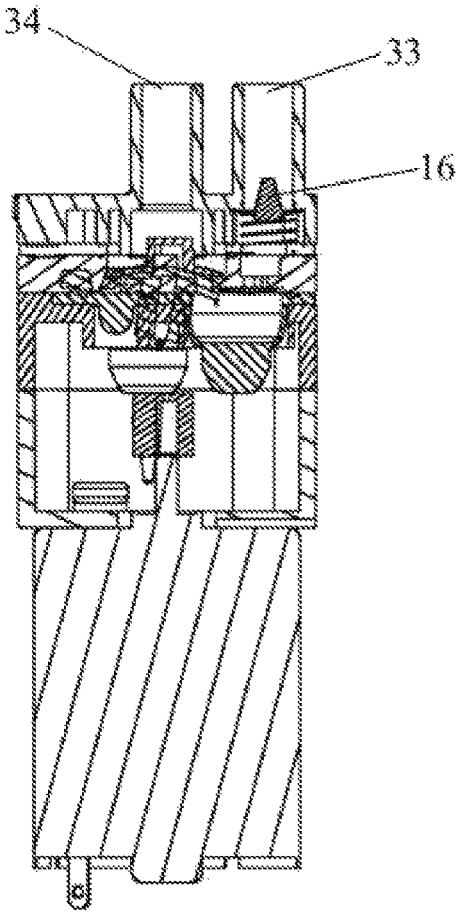
FIG. 8 is a main cross section diagram in accordance with the second embodiment of the present drip tight pump.
Figure 9:
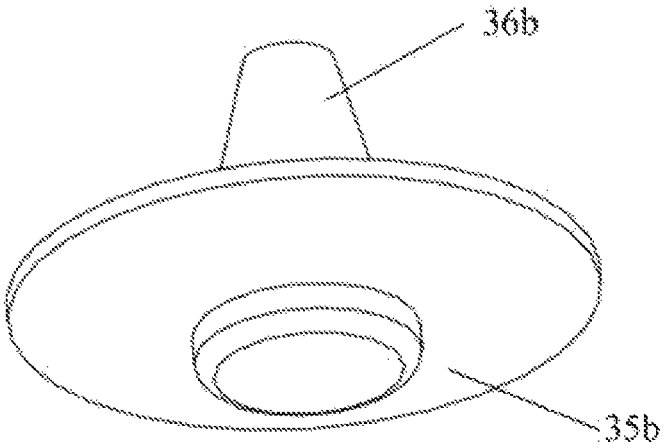
FIG. 9 is a structure diagram of a second leak-proof portion in accordance with the first or the second embodiment of the present drip tight pump.

Referring to FIGS. 7-9, a drip tight pump of a second embodiment is shown. Different from the first embodiment of FIG. 3, the drip tight pump of this embodiment includes a water outlet one-way valve 17 beyond the outlet hole 32. At the same time, the drip tight pump of this embodiment also includes a second leak-proof member between the top cover land the sealing mat 2. The second leak-proof member is used to seal the inlet port 33.

Specifically, the second leak-proof member includes a second elastic portion 15 and a second leak-proof portion 16. The inlet port 33, the second elastic portion 15, and the second leak-proof portion 16 are setting in a same straight line. One end of the second leak-proof portion 16 is connecting a bottom end of the inlet port 33, other end of the second leak-proof portion 16 is connecting a top end of the second elastic portion 15. The second leak-proof portion 16 can slide up and down along inner wall of the inlet port 33 and is used for sealing the inlet port 33.

When using the drip tight pump of the first embodiment, the motor 12 is power on. The output shaft of the motor 12 drives the steel needle 8 rotating by the eccentric wheel 10. Then the rotating steel needle 8 drives the swing frame 7 rotating around the output shaft of the motor 12 and makes arm movement of the swing frame 7 pulling the cup 5 doing stretching and compression motion, so as to changing inside cavity volume of the cup 5. Initially, the second leak-proof portion 16 blocks the inlet port 33 because of action of the second elastic portion 15. When inside cavity volume of the cup 5 is larger, cavity of the cup 5 is inhaling and applying suction to the second leak-proof portion 16. When the suction is larger than elastic force of the second elastic portion 15, the second elastic portion 15 is shrinking downwards and makes the second leak-proof portion 16 leaving the inlet port 33. Liquid flows into the top cover 1 along the inlet port 33 and further flows into the cavity of the cup 5 along the inlet hole 31 through the water inlet one-way valve 4. At this time, the water outlet one-way valve 17 is closed. When inside cavity volume of the cup 5 is smaller, atmospheric pressure of the cup 5 has a positive high value, liquid inside the cup 5 will flow to the top cover 1 along the outlet hole 32 through the water outlet one-way valve 17 then flow out of the drip tight pump from the outlet port 34 of the top cover 1. At this time, the water inlet one-way valve 4 is closed. The motor 12 is power off and stops motion to make the drip tight pump stopping pumping. The cavity of the cup 5 stops inhaling, the cup 5 will apply suction to the second leak-proof portion 16 because of inertia. But when the suction is obviously smaller than elastic force of the second elastic portion 15, the second elastic portion 15 will shrink upwards then the second leak-proof portion 16 move to the inlet port 33, making the second leak-proof portion 16 sealing the inlet port 33 and preventing liquid from flowing inside or outside, and preventing dripping phenomenon of the drip tight pump. At the same time, liquid out of the outlet port 34 will flow back to the drip tight pump. At this time, liquid who is flowing back can't through the outlet hole 32 because of stop of the water outlet one-way valve 17. It can effectively prevent dripping.

Comparing with the prior art, the second elastic portion 15 and the second leak-proof portion 16 are setting between the inlet port 33 and the sealing mat 2. It makes the second leak-proof portion 16 effectively sealing the inlet port 33. When the suction force apply to the second leak-proof portion 16 is larger than elastic force of the second elastic portion 15, the second elastic portion 15 will shrink downwards and the second leak-proof portion 16 leaves the inlet port 33, liquid will flow into the top cover 1 along the inlet port 33 of the top cover 1. When the suction force apply to the second leak-proof portion 16 is smaller than elastic force of the second elastic portion 15, the second elastic portion 15 will stretching upwards and drives the second leak-proof portion 16 moving to the inlet port 33. It makes the second leak-proof portion 16 sealing the inlet port 33.

Referring to FIG. 9, the second leak-proof portion 16 is umbrella-shaped valves. The second leak-proof portion 16 includes a sealing flap 35*b* and a connecting end 36*b* which is connected to top of the sealing flap 35*b* of the second leak-proof portion 16. The sealing flap 35*b* is used to seal the inlet port 33. The sealing flap 35*b* can guarantee tightness of the inlet port 33 effectively. The sealing flap 35*b* makes liquid can't flow into the inlet port 33 after the motor 12 is power off so as to achieve drip tight effect. Preferably, the connecting end 36*b* of the second leak-proof portion 16 shapes like an inverted conical which can lead the second leak-proof portion 16 set into the inlet port 33 and guarantee the second leak-proof portion 16 can slide up and down along inner wall of the inlet port 33 without departing from limit of the inlet port 33 and sealing the inlet port 33 effectively when the drip tight pump is working.

Figure 10:
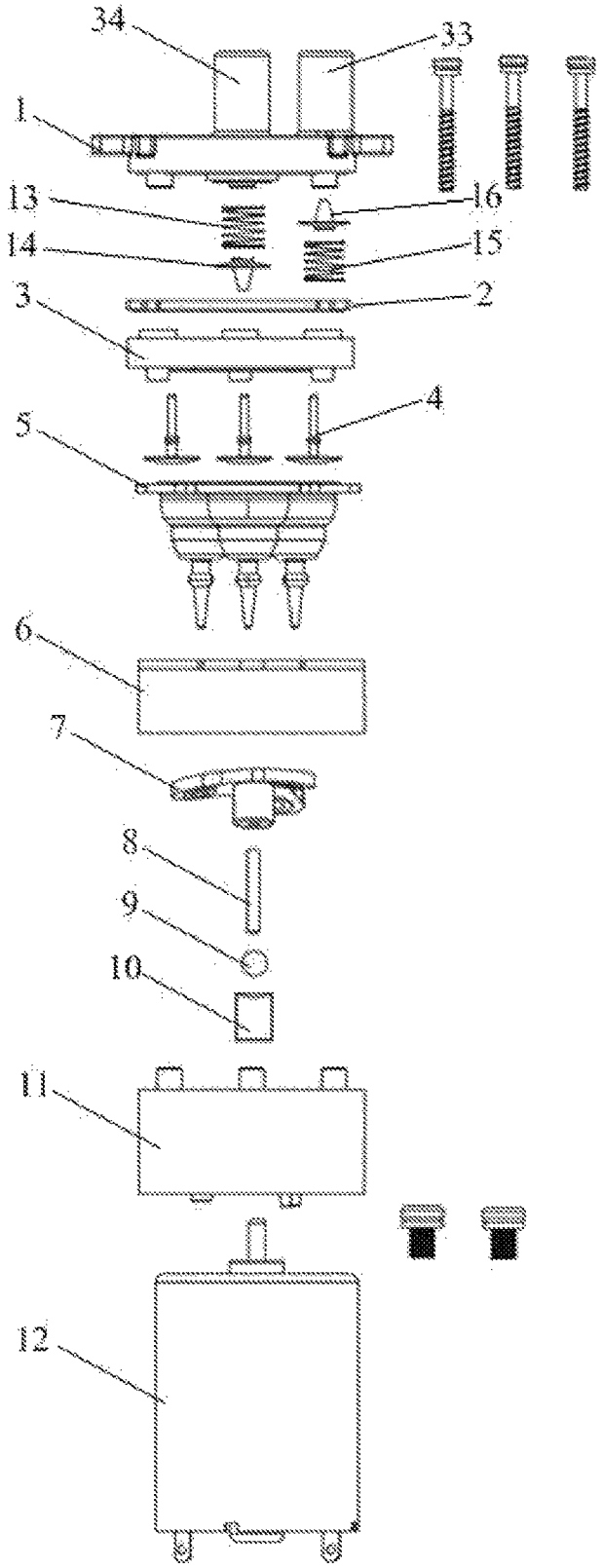
FIG. 10 is an exploded diagram in accordance with a third embodiment of the present drip tight pump.

Referring to FIG. 10, a drip tight pump of a third embodiment is shown. Different from the first embodiment of FIG. 3 and the second embodiment of FIG. 7, the drip tight pump of this embodiment includes a second leak-proof member between the top cover 1 and the sealing mat 2.

When using the drip tight pump of the invention, the motor 12 is power on. The output shaft of the motor 12 drives the steel needle 8 rotating by the eccentric wheel 10. Then the rotating steel needle 8 drives the swing frame 7 rotating around the output shaft of the motor 12 and makes arm movement of the swing frame 7 pulling the cup 5 doing stretching and compression motion, so as to changing inside cavity volume of the cup 5. Initially, the second leak-proof portion 16 blocks the inlet port 33 because of action of the second elastic portion 15. When inside cavity volume of the cup 5 is larger, cavity of the cup 5 is inhaling and applying suction to the second leak-proof portion 16. When the suction is larger than elastic force of the second elastic portion 15, the second elastic portion 15 is shrinking and makes the second leak-proof portion 16 leaving the inlet port 33. Liquid flows into the top cover 1 along the inlet port 33 and further flows into the cavity of the cup 5 along the inlet hole 31 through the water inlet one-way valve 4. At this time, the first leak-proof portion blocks the outlet hole 32 because of action of the first elastic portion 13. When inside cavity volume of the cup 5 is smaller, atmospheric pressure of the cup 5 has a positive high value, liquid inside the cup 5 will apply thrust to the first leak-proof portion 14. When the thrust force is larger than elastic force of the first elastic portion 13, the first elastic portion 13 will shrink and leave the outlet hole 32. Liquid flows into the top cover 1 along the outlet hole 32 and further flow out of drip tight pump along the outlet port 34 through the top cover 1. At this time, the water inlet one-way valve 4 is closed. The motor 12 is power off and stops motion to make the drip tight pump stopping pumping. The cavity of the cup 5 stops inhaling, then liquid inside the cavity of the cup 5 still flow to the outlet hole 32 because inertia. But the thrust force of the liquid applying to the first leak-proof portion 14 is obviously decrease, and makes the thrust force smaller than elastic force, then the first elastic portion 13 is stretching, the first leak-proof portion 14 will block the outlet hole 32 because of action of the first elastic portion 13 achieving the first leak-proof portion 14 sealing the outlet hole 32. It can prevent liquid inside the cup 5 from flowing out, and prevent dripping phenomenon of the drip tight pump. At the same time, liquid out of the outlet port 34 will flow back to the drip tight pump. At this time, liquid who is flowing back can't through the outlet hole 32 because of stop of the first leak-proof portion 14. It can effectively prevent dripping phenomenon. In additional, if the cup 5 apply suction to the second leak-proof portion 16 because of inertia but the suction is obviously decrease, and makes the suction force smaller than elastic force, the second elastic portion 13 will stretching and drives the second leak-proof portion 16 moving to the inlet port 33. It makes the second leak-proof portion 16 sealing the inlet port 33 and prevents liquid from flowing inside or outside. Therefore, the outlet hole 32 and the inlet port 33 can be sealed by cooperation of the first leak-proof member and the second leak-proof member. It prevents dripping phenomenon during suction and pumping. The first elastic portion 13 and the second elastic portion 15 are preferred springs.

Comparing with the prior art, the first leak-proof portion 14 and second leak-proof portion 16 are set between the inlet port 33 and outlet hole 32 at the same time. It makes the first leak-proof portion 14 sealing the outlet hole 32 effectively and the second leak-proof portion 16 sealing the inlet port 33 effectively.

It should be noted that, the first elastic portion and the second elastic portion can be changed from different elastic portion of different elastic coefficient according to actual use requirements. By controlling the elastic coefficient of the first elastic portion and the second elastic portion, drip tight effect of the drip tight pump can be guarantee. The drip tight pump has strong flexibility and applicability.

From the above description, by the first leak-proof portion 14 and/or the second leak-proof portion 16 sealing the outlet hole 32 and/or the inlet port 33 effectively, it prevents dripping phenomenon of the drip tight pump of this invention.

It is believed that the present disclosure and its advantages will be understood from the forgoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. A drip tight pump, comprising a top cover with an inlet port and an outlet port, a sealing mat, a valve plate with an inlet hole and an outlet hole, a water inlet one-way valve, a cup, a cylinder, a swing frame, a steel needle, a steel ball, an eccentric wheel, a bottom cover and a motor which are successively set, wherein the drip tight pump also comprising a first leak-proof member and a second leak-proof member between the top cover and the sealing mat, the first leak-proof member comprising a first elastic portion and a first leak-proof portion, the outlet port, the first elastic portion, the first leak-proof portion and the outlet hole are set in a same straight line, one end of the first elastic portion is connecting a bottom end of the outlet port, another end of the first elastic portion is connecting a top end of the leak-proof portion, the first leak-proof portion is used for sealing the outlet hole, the second leak-proof member comprising a second elastic portion and a second leak-proof portion, the inlet port, the second elastic portion, and the second leak-proof portion are set in a same straight line, one end of the second leak-proof portion is connecting a bottom end of the inlet port, another end of the second leak-proof portion is connecting a top end of the second elastic portion, the second leak-proof portion is used for sealing the inlet port;

the sealing mat extends across an entire diameter of the drip tight pump; the first leak-proof member and the second leak-proof member are located axially between the sealing mat and the top cover.

2. The drip tight pump of claim 1, wherein the first leak-proof portion and the second leak-proof portion are umbrella-shaped valves.

3. The drip tight pump of claim 2, wherein the umbrella-shaped valves each comprise a sealing flap and a connecting end which is integrally formed with the sealing flap.

4. The drip tight pump of claim 3, wherein the connecting end of the first leak-proof portion is set at a bottom end of the sealing flap of the first leak-proof portion, the connecting end of the first leak-proof portion is shaped like an inverted conical.

5. The drip tight pump of claim 3, wherein the connecting end of the second leak-proof portion is set at a top end of the sealing flap of the second leak-proof portion, the connecting end of the second leak-proof portion is shaped like an inverted conical.

6. The drip tight pump of claim 1, wherein the first elastic portion and the second elastic portion are springs.

7. The drip tight pump of claim 1, wherein the water inlet one-way valve is an umbrella-shaped valve used for sealing the inlet hole.

8. The drip tight pump of claim 1, wherein the top cover, the valve plate and the cylinder are fastened on the bottom cover by screws.

9. The drip tight pump of claim 1, wherein the bottom cover and the motor are connected by screws.

* * * * *